US006352054B1

(12) United States Patent
Yamada et al.

(10) Patent No.: US 6,352,054 B1
(45) Date of Patent: Mar. 5, 2002

(54) CATALYTIC COMBUSTION HEATER

(75) Inventors: Tomoji Yamada, Kariya; Shoji Hirose, Nissin; Shigeru Ogino, Toyota, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/509,826

(22) PCT Filed: Oct. 19, 1998

(86) PCT No.: PCT/JP98/04714

§ 371 Date: Jun. 23, 2000

§ 102(e) Date: Jun. 23, 2000

(87) PCT Pub. No.: WO99/20948

PCT Pub. Date: Apr. 29, 1999

(30) Foreign Application Priority Data

Oct. 20, 1997 (JP) ..... 9/306556

(51) Int. Cl.[7] ..... F22B 23/06

(52) U.S. Cl. ..... 122/367.1; 122/4 D; 122/7 R; 122/367.3; 165/299; 165/300

(58) Field of Search ..... 122/4 D, 7 R, 122/367.1, 367.3; 165/299, 300

(56) References Cited

U.S. PATENT DOCUMENTS 6,167,846 B1 * 1/2001 Ogino et al. ..... 122/367.1

FOREIGN PATENT DOCUMENTS

| | | |
|---|---|---|
| JP | 57-131957 | 8/1982 |
| JP | 4-57072 | 5/1992 |
| JP | 5-223201 | 8/1993 |
| JP | 6-42720 | 2/1994 |

* cited by examiner

*Primary Examiner*—Jiping Lu
(74) *Attorney, Agent, or Firm*—Oblon, Spivak, McClelland, Maier & Neustadt, P.C.

(57) ABSTRACT

A catalytic combustion heat exchanger includes a fuel gas passage and a number of tubes, which are located in the fuel gas passage. Fuel gas flows in the fuel gas passage. An object fluid, which is heated by the heat exchanger, flows in the tubes. Fins, which carry a catalyst, are fixed to the outer surfaces of the tubes. The fluid is heated by an oxidation reaction of the fuel gas that occurs on the surface of the fins. When the heat exchanger is initially activated, the controller maintains the flow rate of the object fluid at a relatively low rate until a temperature detector detects that the temperature of the object fluid is higher than a certain level to limit heat transfer from the fins to the object fluid. This increases the fin temperatures throughout the heat exchanger. The controller increases the flow rate of the object fluid when the temperature of the object fluid exceeds a certain level, to increase heat transfer to the object fluid. The control method prevents the fins from overheating and speeds up the initial activation of the heat exchanger.

9 Claims, 7 Drawing Sheets

CATALYTIC COMBUSTION HEATER

TECHNICAL FIELD

The present invention relates to a catalytic combustion heater that heats an object fluid with heat from an oxidation reaction of a fuel gas with a catalyst, and, more particularly, to a catalytic combustion heater that has a short activation time, when the heater is activated.

FIELD OF THE INVENTION

A so-called catalytic combustion heater, which causes an oxidation reaction of a flammable gas (fuel gas) with a catalyst and heats an object fluid using the generated heat, is known, and various applications of the heater, such as home use and vehicular use, have been studied (for example, Japanese Unexamined Patent Publication (KOKAI) No. Hei 5-223201, etc.). A catalytic combustion heater is equipped with a catalyst-carrying heat exchanger having tubes located in a flow passage of a flammable gas and in which an object fluid to be heated which is a liquid or gas flows, with multiple catalyst-carrying fins integrally joined to the outer surfaces of the tubes. The multiple fins carry an oxidation catalyst, such as platinum or palladium. When the catalyst-carrying fins are heated to or above an activation temperature and contact a flammable gas, an oxidation reaction occurs on the surfaces of the fins. The oxidation reaction generates heat, which is transferred from the fins into the tubes to heat the object fluid that flows in the tubes.

The flammable gas is mixed with a combustion support gas (normally, air) for oxidizing the flammable gas, and is then supplied as a fuel gas into the catalyst-carrying heat exchanger. Because the catalyst-oriented oxidation reaction occurs in a very wide range of the flammable gas concentration, unburned gas, which has not reacted at an upstream location can be burned with a catalyst at a downstream location, and combustion can be carried out along the entire heat exchanger. This provides a compact and high-performance heater as compared with burner type heaters, which have been typical so far.

It is desirable to rapidly raise the temperature of fins to quickly make the catalyst of the entire system active when the catalytic combustion heater is activated. Normally, therefore, means for detecting multiple temperatures, such as the fin temperature, the temperature of the object fluid to be heated and the combustion-exhaust-gas temperature, based on a previously prepared map are provided, so that the flow rate of the object fluid is gradually increased to a specified rate while monitoring the temperatures. In the case of heating water of normal temperature to vapor at 300° C., for example, the flow rate of the object fluid is controlled such that the flow rate of the object fluid is set to zero until the fin temperature on the upstream side of a flammable-gas flow passage reaches the activation temperature, and the fin temperature does not fall below the activation temperature thereafter while making sure that the other catalysts become active in order and the activation temperature is maintained.

However, the conventional catalytic combustion heater must monitor multiple temperatures or detect the fin temperature and the temperature of the object fluid at plural locations in the flammable-gas flow passage and requires complicated control procedure. Further, the heater may not start as expected, depending on variations in the initial temperature of the object fluid or the combustion support gas. Furthermore, if the flow rate of the object fluid is not controlled properly, e.g., if the flow rate is too small, the heat generated on the fin surfaces is not transferred away, which heats the fins and tubes locally and deteriorates the catalyst. If the flow rate is too large, on the other hand, the fin temperature is too low and the catalyst reaction does not occur. This leads to the discharge of unburned gas, which deteriorates the exhaust emissions. There is another problem in that it takes too long to activate the heat exchangers.

SUMMARY OF THE INVENTION

The present invention has been devised to overcome the above conventional problems, and it is an object of the present invention to provide a safe and quick-activating catalytic combustion heater that activates quickly with a simple structure while preventing local heating of the fins and the tubes and preventing discharge of unburned gas.

A catalytic combustion heater according to the present invention is equipped with a catalyst-carrying heat exchanger having tubes located in a fuel-gas flow passage, the interiors of which serve as an object fluid flow passage. Fins are joined to outer surfaces of the tubes and carry an oxidation catalyst for causing an oxidation reaction when contacting a fuel gas. An object fluid is heated by oxidation reaction heat of the fuel gas. The heater includes means for detecting the temperature of the object fluid in the vicinity of an outlet of the object fluid flow passage and flow-rate control means for controlling the flow rate of the object fluid when the heater is activated based on the temperature of the object fluid detected by the temperature detecting means. The flow-rate control means maintains a small flow rate of the object fluid until the temperature of the object fluid exceeds a predetermined temperature and increases the flow rate of the object fluid when the temperature of the object fluid exceeds the predetermined temperature.

When heating the object fluid, the amount of heat required to raise the liquid to the boiling point is smaller than the latent heat for converting the liquid to a gas. The way heat is transferred in the tubes varies in accordance with the state of the object fluid. For example, the heat transfer coefficient of an object fluid in a liquid state is lower than that of an object fluid in a boiling state, which is a gas-liquid mixed state. Accordingly, the activation control can be carried out well by detecting the temperature of the object fluid in the vicinity of the outlet of the passage where the object fluid becomes hottest, to find the state of the object fluid, and by controlling the flow rate of the object fluid based on that state. That is, in the initial stage of heating, the flow rate of the object fluid is maintained low to suppress heat transfer to the object fluid, thereby quickly raising the temperatures of the fins and tubes to the activation temperature. When the temperature of the object fluid exceeds a predetermined temperature, e.g., the boiling point, the flow rate of the object fluid is increased to increase the flow speed, which increases the heat transfer to the object fluid. This prevents the temperatures of the fins and tubes from becoming too high. In this manner, the generated heat can be used effectively to make the entire heater activate quickly. Therefore, the heater can provide the desired high temperature gas in a short activation time, has a simple structure, need not monitor multiple temperatures, and is very safe.

In one embodiment, the flow-rate control means performs control to set the flow rate of the object fluid to a low rate, when the heater is activated, so that the flow of the object fluid becomes laminar, maintains that flow rate until a typical boiling point of the object fluid is exceeded, and increases the flow rate of the object fluid to a specified rate when the temperature of the object fluid exceeds the typical boiling point.

Specifically, the flow rate of the object fluid is controlled based on the boiling point of the temperature of the object fluid, and the flow rate of the object fluid is kept low to make the flow speed sufficiently low. Particularly, if the flow of the object fluid is kept laminar, the heat resistance is increased, making heat transfer in the tubes difficult. Accordingly, the temperatures of the fins and tubes increase, thus ensuring quick activation. Since the quantity of the object fluid is small, it boils relatively quickly. Because the heat resistance abruptly decreases in the boiling state, and heat transfer becomes easier, the vaporization of the object fluid is increased while the flow rate is small. When all of the object fluid is vaporized, the heat transfer coefficient becomes low again, and, when the temperature of the object fluid exceeds the boiling point, the flow rate of the object fluid is increased at once. This increases the flow speed to increase the heat transfer to the object fluid, so that good activation control is performed in a short time while preventing the temperatures of the fins and tubes from becoming abnormally high.

In one embodiment, the flow-rate control means controls the flow rate of a combustion support gas while being mixed in the fuel gas, based on the temperature of the object fluid. Since the flow rate of the combustion support gas is controlled in addition to the control of the flow rate of the object fluid, the generated heat can be used more effectively.

In one embodiment, the direction of the flow of the fuel gas in the catalyst-carrying heat exchanger is opposite to the direction of the flow of the object fluid. At this time, the flow-rate control means performs control to increase the flow rate of the combustion support gas to or above a specified rate when the temperature of the object fluid exceeds its typical boiling point. In another embodiment, the control means performs control to decrease the flow rate of the combustion support gas to the specified rate when the temperature of the object fluid becomes stable in the vicinity of a target temperature.

When the direction of the flow of the fuel gas is opposite to that of the object fluid, the flow rate of the combustion support gas is not increased more than necessary and the flow speed of the flammable gas that contacts the fin surfaces is slowed until the object fluid in the vicinity of the outlet of the object fluid, where the fuel gas having a high flammable-gas concentration is supplied is boiled. This makes it hard to transfer the generated heat to the flammable gas, and the temperature of the catalyst quickly rises to the activation temperature. When the flow rate of the combustion support gas is increased, the transfer of the heat generated by the oxidation reaction becomes easier, the heat is carried downstream with the faster flowing fuel gas and the combustion exhaust gas. When the object fluid reaches the boiling point, where the heat resistance becomes low, the flow rate of the combustion support gas is increased to allow the downstream fins and tubes to be exposed to the high-temperature gas, so that the temperature of the entire heater is quickly increased to or above the catalyst activation temperature. When the temperature of the object fluid becomes stable in the vicinity of a predetermined temperature, the flow rate of the combustion support gas is decreased to the specified rate to reduce the amount of heat discharged with the combustion exhaust gas, so that the heat exchanging efficiency is well maintained.

In one embodiment, the direction of the flow of the fuel gas in the catalyst-carrying heat exchanger is the same as the direction of the flow of the object fluid. Further, the flow-rate control means performs control to make the flow rate of the combustion support gas greater than a specified rate from when the heater is activated until the temperature of the object fluid exceeds its typical boiling point and to decrease the flow rate of the combustion support gas to the specified rate when the temperature of the object fluid exceeds the typical boiling point.

When the direction of the flow of the fuel gas is the same as that of the object fluid, it is better to quickly make the catalyst active on the downstream side of the fuel-gas flow passage, where the temperature of the object fluid is the highest, to prevent deterioration of the exhaust emissions. Therefore, the heat generated on the fin surfaces is more easily transferred to the flammable gas by making the flow rate of the combustion support gas greater than the specified rate from the time when the heater is activated until the temperature of the object fluid in the vicinity of the object fluid outlet boils. This causes the downstream fins and tubes to be exposed to the high-temperature gas, thus ensuring a quick increase in the catalyst activation temperature. When the object fluid exceeds the boiling point, the flow rate of the combustion support gas is reduced to suppress the amount of heat discharged with the exhaust gas, thus improving the heat exchanging efficiency.

In one embodiment, a plurality of the tubes are provided for each of a plurality of rows in the path of the flow of the fuel gas, and the number of the tubes in an upstream row is greater than that of the other rows.

Upstream in the flow of the fuel gas, the object fluid has a high temperature and expands when it vaporizes, so that the number of tubes is increased to increase the total cross-sectional area of the tubes, thus limiting pressure loss.

In one embodiment, a plurality of the tubes are provided for each of a plurality of rows in the path of the flow of the fuel gas, and the surface area of the fins of the tubes in an upstream row is smaller than that of other rows.

Upstream in the flow of the fuel gas, the temperature of the object fluid is high, and the fins and tubes are prevented from being heated more than needed by reducing the surface area of the fins.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Embodiments of a catalytic combustion heater according to the present invention will now be described with reference to the accompanying drawings.

(First Embodiment)

Figure 1:
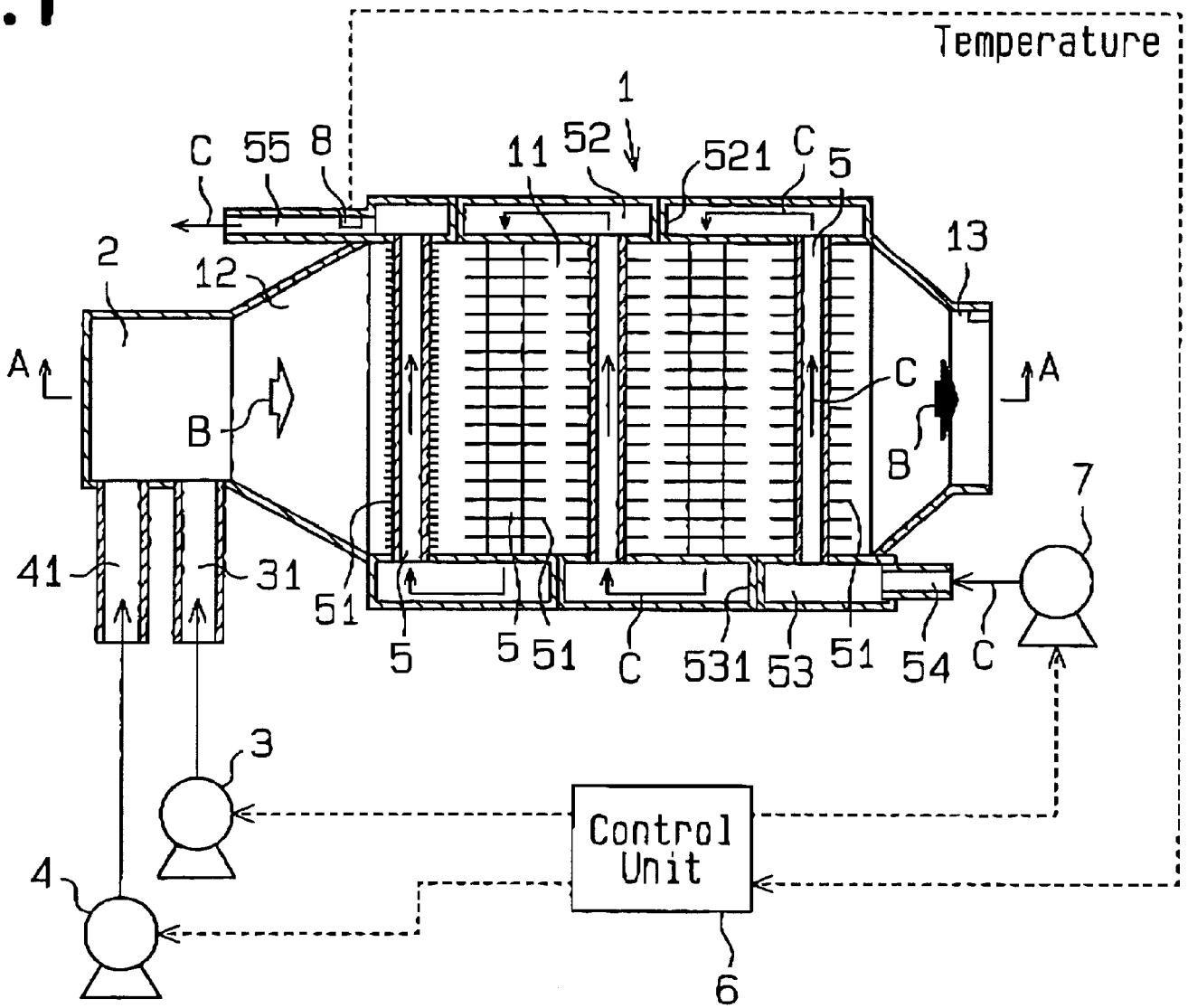
FIG. 1 is a general cross-sectional view of a catalytic combustion heater showing a first embodiment of the present invention.

FIG. 1 is a general cross-sectional view of a catalytic combustion heater showing the first embodiment of the present invention. In FIG. 1, a catalyst-carrying heat exchanger 1 has a fuel-gas flow passage 11 formed in a cylindrical container with open ends, and a fuel gas is allowed to flow toward an exhaust-gas port 13 (in the direction indicated by the arrows B in the diagram) at the right end portion from a fuel-gas feed port 12 at the left end portion. Coupled to the fuel-gas feed port 12 is a cylindrical body with a closed left end, which constitutes a fuel-gas feeding section 2, the bottom wall of which is connected to a fuel feed passage 31, which communicates with a fuel feeding unit 3, and a combustion-support-gas feed passage 41, which communicates with a combustion support gas feeding unit 4. A flammable gas, which serves as fuel, and a combustion support gas, which are supplied respectively from the fuel feeding unit 3 and the combustion-support-gas feeding unit 4, are mixed in the fuel-gas feeding section 2 and are supplied as a fuel gas into the fuel-gas flow passage 11 from the fuel-gas feed port 12.

For example, a flammable gas such as hydrogen or methanol is used as the fuel, air is normally used as a combustion support gas, and the flow rates of the flammable gas and the combustion support gas are controlled by a control unit 6, which is a control means. It is preferred that the feed rate of the combustion support gas in the fuel gas should be in a range of about 1 to 5 times the theoretical amount of air that is needed to oxidize all the flammable gas and should be set as small as possible within a range where it does not exceed the heat-resisting temperature to efficiently recover the generated heat during normal combustion. However, because the combustion support gas is used as a heat transfer medium during activation, as will be discussed later, the flow rate is increased according to need.

Figure 2:
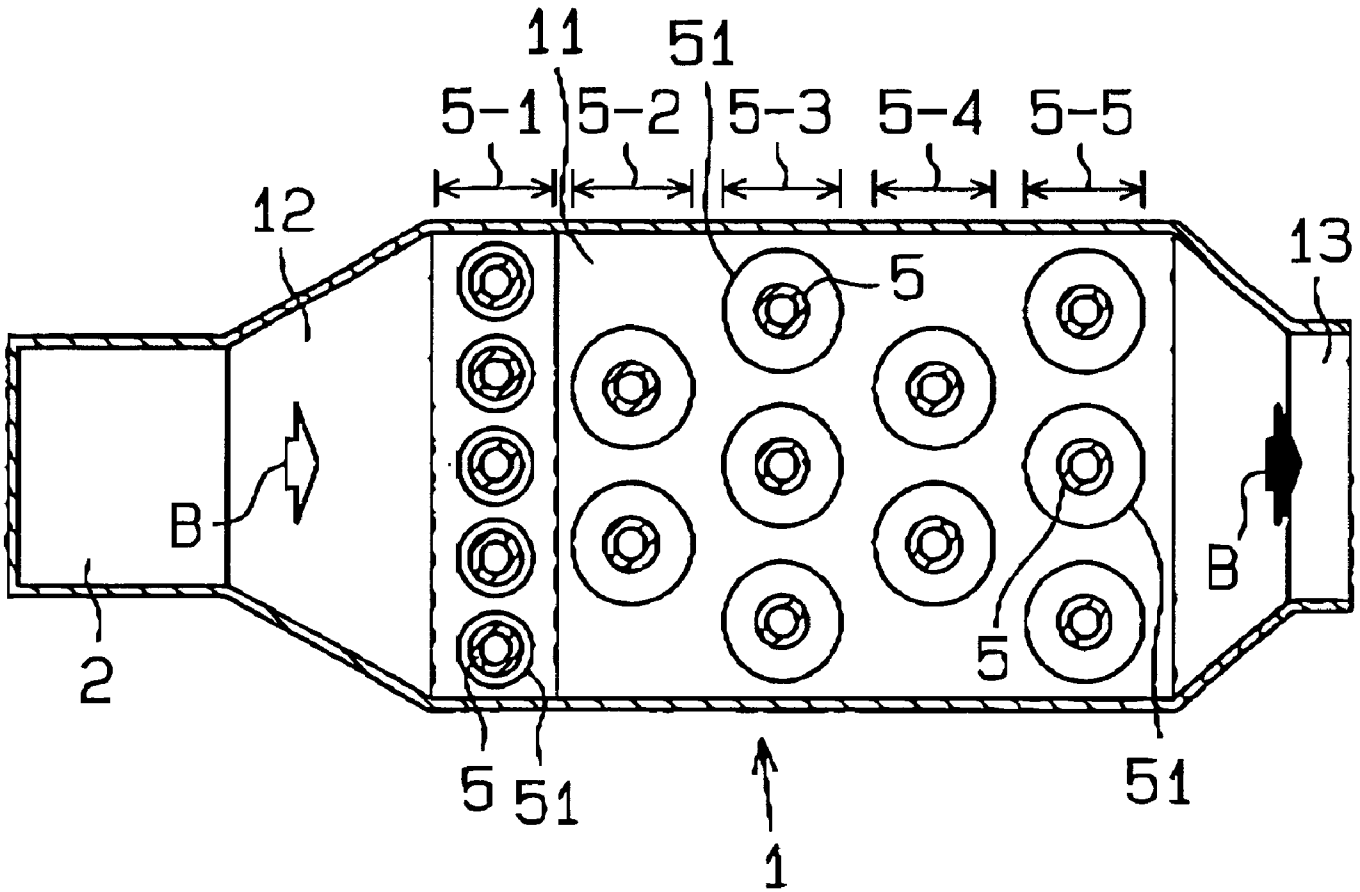
FIG. 2 is a cross-sectional view along the line A—A in FIG. 1.

FIG. 2 is a cross-sectional view taken along the line A—A in FIG. 1. In FIG. 2, multiple tubes 5, through which the object fluid flows, are provided in the fuel-gas flow passage 11 of the catalyst-carrying heat exchanger 1 in rows in the flow path of the fuel gas. That is, a plurality of tubes 5 are located in each of a plurality of rows 5-1, 5-2, 5-3, 5-4 and 5-5 which are placed one after another in the direction of the flow of the fuel gas. Multiple annular fins 51 are integrally connected to the outer surface of each tube 5 by brazing or the like. An oxidation catalyst such as platinum or palladium is carried on the surfaces of those fins 51, and an oxidation reaction occurs when the fuel gas contacts the surface of the oxidation catalyst. The heat generated by the oxidation reaction is transferred to the tubes 5 from the fins 51 to heat the object fluid that flows inside the tubes 5.

In FIG. 1, both ends of the multiple tubes 5 are respectively coupled to tube joining chambers 52 and 53 provided at the top and bottom portions of the catalyst-carrying heat exchanger 1. Partitions 521 and 531 are respectively formed at plural locations in the tube joining chambers 52 and 53 to define a plurality of subchambers. An inlet pipe 54 for the object fluid is coupled to the right end of the lower tube joining chamber 53, and an outlet pipe 55 for the object fluid is coupled to the left end of the upper tube joining chamber 52. The tubes 5, the tube joining chambers 52 and 53, the inlet pipe 54, and the outlet pipe 55 form a passage for the object fluid that is directed upstream from the downstream end of the fuel-gas flow passage, as indicated by the arrows C in the diagram. The object fluid is introduced from the inlet pipe 54 by an object fluid feeding unit 7, is heated to a high temperature as it flows in the tubes 5 and the tube joining chambers 52 and 53, and is led outside from the outlet pipe 55. The object fluid is, for example, water, and its flow rate is adjusted when the aforementioned control unit 6 controls the object fluid feeding unit 7.

The outside diameter of and the number of the fins 51 provided on the outer surfaces of the tubes 5 are properly set in accordance with the amount of heat needed for the object fluid in the joined tubes 5. According to this embodiment, the outside diameter of the fins 51 is smaller (shown in FIG. 2) for the tubes 5 of the most upstream row 5-1 in the fuel-gas flow passage 11. Because the object fluid in the tubes has a high temperature at the upstream end of the fuel-gas flow passage 11, the surface area of the fins 51 is smaller to limit the heat generation, so that the fins 51 and the tubes 5 are not heated more than necessary. It is preferred that the number of the tubes 5 in each of the rows 5-1 to 5-5 increase in the upstream direction. This is because, when the object fluid, when liquid, is heated and is vaporized, it expands, and the pressure loss becomes large unless the total cross-sectional area of the individual tubes 5 in the upstream rows is large. If the individual tubes 5 of one row and the individual tubes 5 of another adjoining row are arranged alternately, as shown in FIG. 2, the effective length of the fuel-gas flow passage 11 increases, thus improving the heat exchanging efficiency.

A temperature detector 8, which is a temperature detecting means, that detects the temperature of the object fluid is provided on the pipe wall of the outlet pipe 55, which is the outlet of,the flow passage of the object fluid. A known temperature sensor can be used as the temperature detector 8. In this embodiment, the state of the object fluid is determined from the temperature of the object fluid detected by the temperature detector 8, and the control means 6 controls the object fluid feeding unit 7 and the combustion support gas feeding unit 4 based on the detection result, thereby adjusting the flow rate of the object fluid and the flow rate of the combustion support gas. The control process will be described below.

Figure 3:
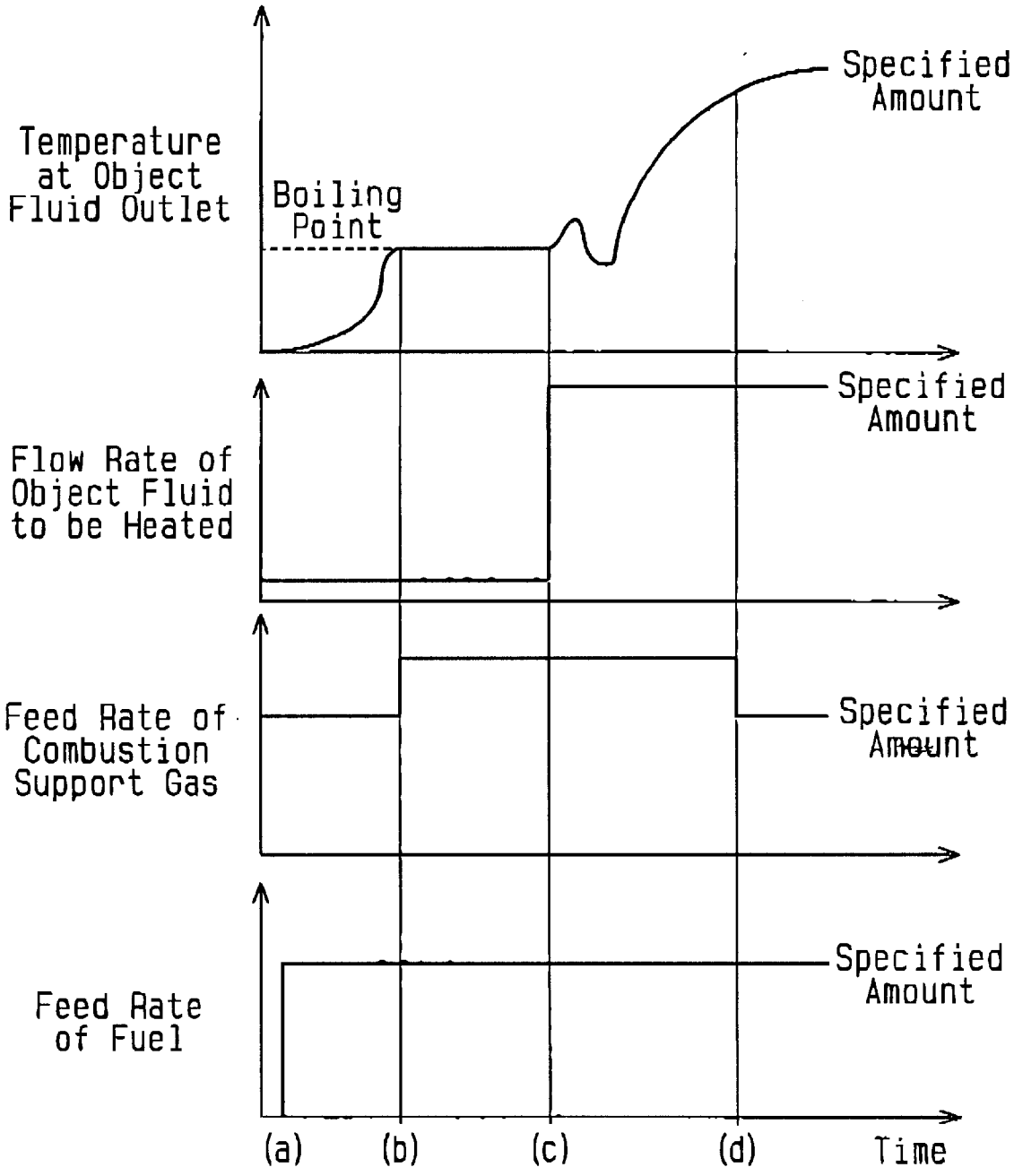
FIG. 3 is a diagram showing the behaviors of individual fluids according to the first embodiment.

FIG. 3 shows time-dependent variations in the temperature of the object fluid at the outlet and the flow rates of various fluids. At time (a) in FIG. 3 or at the time of activation of the catalytic combustion heater, the temperature of the entire heater is low and the catalyst temperature is also low and has not reached the activation temperature yet. In this state, it is better to make the transfer of the reaction heat generated on the surfaces of the fins 51 to the object fluid in the tubes 5 difficult to quickly raise the temperature of the surfaces of the fins 51 to the catalyst activation temperature. Therefore, the control unit 6 controls the object fluid feeding unit 7 to adjust the flow rate to a small rate, so that the flow of the object fluid in the tubes 5 becomes laminar and the object fluid has a large heat resistance. The heat resistance is defined by the following equation (1):

$$\text{heat resistance}=1/(\text{heat transfer coefficient}\times\text{contact area}) \quad (1)$$

Since the contact area is constant, the heat resistance differs in accordance with the heat transfer coefficient of the object fluid or the state of the object fluid. If the flow rate of the object fluid is small and the flow speed is sufficiently low, for example, the object fluid flow is laminar the upstream side to the downstream side, which reduces the heat transfer to the inner layer from the outer layer (the heat transfer coefficient is small). Therefore, the heat generated on the surfaces of the fins 51 is used to heat the catalyst and quickly raises it to the catalyst activation temperature.

The flow rate at which the object fluid flow becomes sufficiently laminar is normally about one-third of a specified rate or smaller the specified rate is an normal rate and is the higher rate in FIG. 3. The feeding of the object fluid starts at about the same time as the activation of the heater, and the individual fluids are controlled based on the temperature at the outlet, which is detected by the temperature detector B. Further, by making the flow rate amount of the object fluid low from the time of activation, it is possible to prevent the temperature of the fins 51 from rising as a result of heating in an empty state due to bubbles in the tubes 5 or absence of the object fluid. At this time, if the feed rate of the combustion support gas is large, the gas flow speed is increased and the generated heat is absorbed by the fuel gas or the combustion exhaust gas, and the flow rate of the combustion support gas should not be greater than necessary. Accordingly, first, the fins 51 at the upstream end of the fuel-gas flow passage 11, where the high-concentration fuel gas is supplied, are heated to reach the activation temperature and the catalytic combustion starts.

In general, when a liquid is heated to vapor, the amount of heat needed to raise the temperature to the boiling point is smaller than that required for converting the liquid to a gas, or the latent heat. Therefore, the temperature of the object fluid that flows in the tubes 5 at the upstream end (left-hand end in the diagram) of the fuel-gas flow passage 11, where the concentration of the flammable gas is high, rises relatively fast and reaches the boiling point. Generally speaking, it is known that when a fluid is boiling, the motion of the fluid particles in the gas-liquid mixed state is increased, which increases heat transfer and decreases the heat resistance. That is, when the object fluid boils, the heat generated on the surfaces of the fins 51 transfers more easily to the object fluid in the tubes 5. When the temperature of the object fluid detected by the temperature detector 8 reaches the boiling point (time (b) in FIG. 3), therefore, the flow rate of the combustion support gas is controlled to increased above the specified rate by the combustion support gas feeding unit 4. Accordingly, some of the heat generated on the surfaces of the fins 51 is carried to the downstream end (rightward in the diagram) by the combustion exhaust gas and heats the fins 51 and tubes 5 on the downstream end of the fuel-gas flow passage 11, which raises the temperature of the entire heater to or above the activation temperature of the catalyst.

When combustion progresses further and the entire object fluid is vaporized, the temperature of the object fluid rises above the boiling point (time (c) in FIG. 3). When the temperature of the object fluid exceeds the boiling point, the control unit 6 controls the object fluid feeding unit 7 to increase the flow rate of the object fluid to the specified rate. This increases the flow speed of the object fluid in the tubes 5, making it easier for the heat generated on the surfaces of the fins 51 to be transferred to the object fluid in the tubes 5 and making it possible to heat the object fluid to quickly acquire the high-temperature gas of a predetermined temperature. At this time, as the flow rate of the object fluid is increased rapidly, the temperature of the object fluid drops temporarily but the flow rate of the flammable gas is set to cause the specified amount of object fluid to be heated sufficiently with the heat generated when the flammable gas is combusted, and the temperature starts to rise again soon because the heat transfer to the object fluid is performed more effectively as the flow speed gets increases.

Thereafter, when the temperature of the object fluid becomes about 80% of the target temperature (time (d) in FIG. 3), the control unit 6 sends a signal to the combustion support gas feeding unit 4 to reduce the flow rate of the combustion support gas to a predetermined rate. This prevent the heat generated on the surfaces of the fins 51 from being transferred to other than the object fluid in the tubes 5 and reduces the temperature of the combustion exhaust gas, thereby increasing the heat exchanging efficiency.

Figure 4:
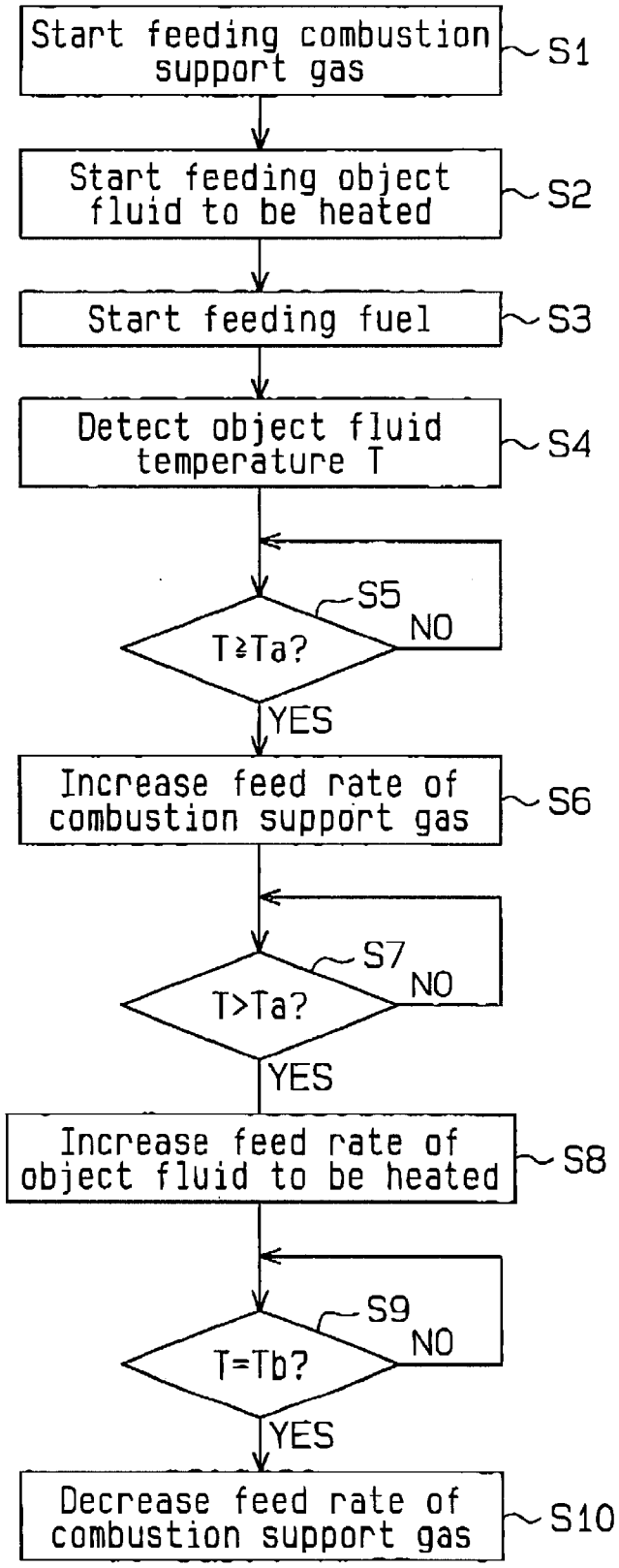
FIG. 4 is a flowchart illustrating a control method according to the first embodiment.

FIG. 4 shows the flowchart of the control performed by the control unit 6. According to this flowchart, when the control procedure of this system is initiated, first, the control unit 6 sends control signals to the combustion support gas feeding unit 4 and the object fluid feeding unit 7 to cause the combustion support gas feeding unit 4 to start feeding a specified amount of combustion support gas and to cause the object fluid feeding unit 7 start feeding a predetermined small amount of object fluid. Also, the control unit 6 sends a control signal to the fuel feeding unit 3 to cause the fuel feeding unit 3 to start feeding a specified amount of flammable gas (steps 1, 2 and 3).

Next, when the temperature detector 8 detects the temperature T of the object fluid (step 4), the control unit 6 determines if this temperature T is equal to or higher than the typical boiling point Ta of the object fluid (step 5). This step is repeated until $T \geqq Ta$. When $T \geqq Ta$ is met, a control signal is sent to the combustion support gas feeding unit 4 to increase the flow rate of the combustion support gas (step 6). Again, the temperature T of the object fluid is detected by the temperature detector 8 and it is determined whether or not the temperature T has exceeded the boiling point Ta (step 7). This is repeated and when $T>Ta$ is met, the control unit 6 controls the object fluid feeding unit 7 to increase the flow rate of the object fluid to the specified rate (step 8). Further, the control unit 6 determines if the temperature T of the object fluid has reached a temperature Tb that is about 80% of the target gas temperature (step 9). This is repeated and when $T=Tb$ is met, the control unit 6 sends a control signal to the combustion-support-gas feeding unit 4 to reduce the flow rate of the combustion support gas to the specified rate (step 10).

As described above, the catalytic combustion heater according to this embodiment is safe, has a short activation time and can shorten the time for acquiring water vapor of, for example, 300° C. to several minutes as opposed to the more than ten minutes conventionally required. According to the constitution of this embodiment, the advancing direction of the object fluid is opposite to the direction of the flow of the fuel gas, and the closer a location is to the downstream end of the fuel-gas flow passage 11 or the exhaust-gas port 13, the lower the temperature of the object fluid becomes. In this case, as the combustion exhaust gas contacts the tubes 5 where the cooler object fluid flows, the heat in the exhaust gas is recovered efficiently, and the heat exchange efficiency is high.

(Second Embodiment)

Figure 5:
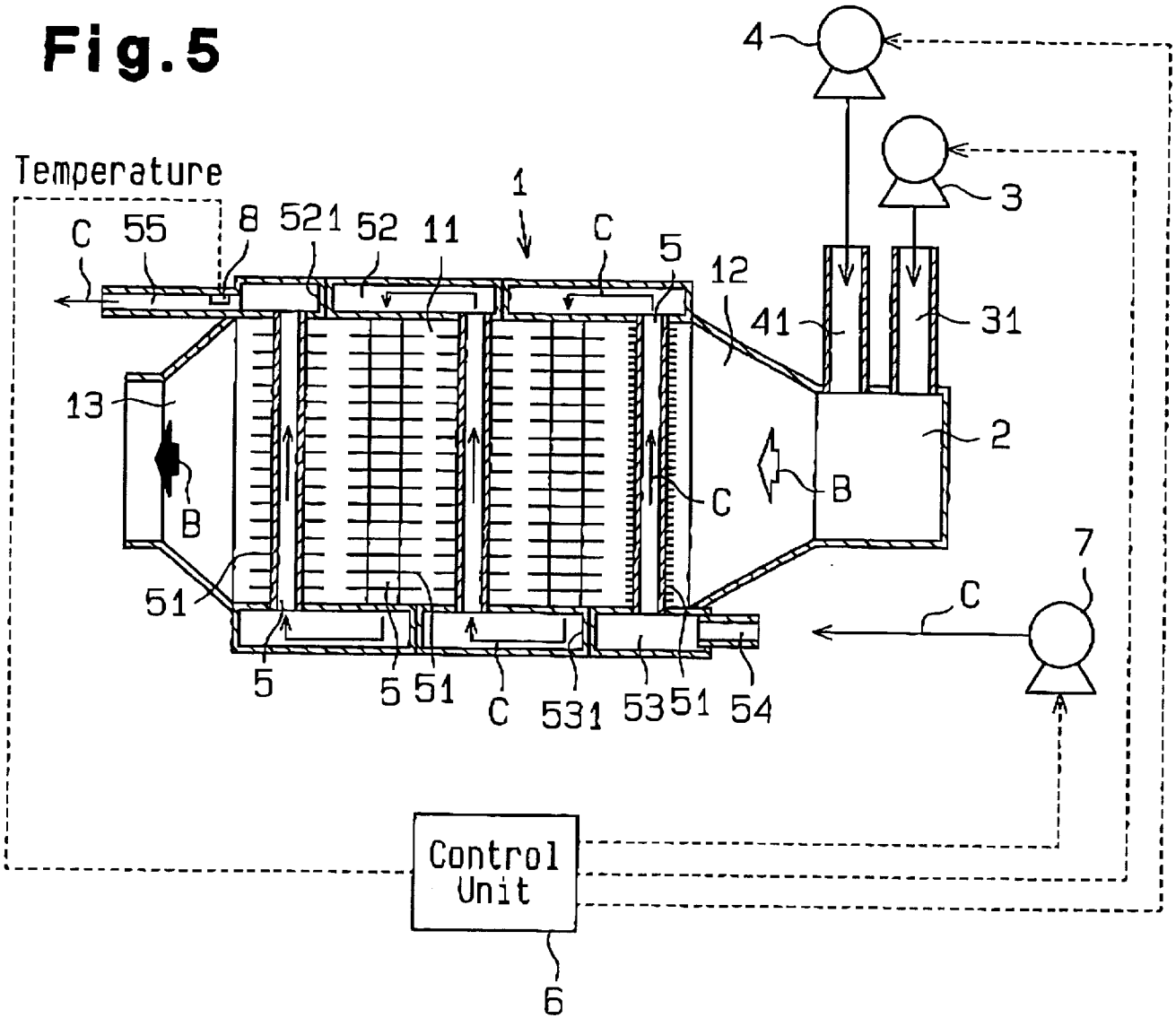
FIG. 5 is a general cross-sectional view of a catalytic combustion heater showing a second embodiment of the present invention.

FIG. 5 is a general cross-sectional view of a catalytic combustion heater showing the second embodiment of the present invention. In this embodiment, the flow direction of the object fluid is the same as the flow direction of the fuel gas, and the fuel-gas feeding section 2 is provided at the right-end portion of the heat exchanger 1 so that the fuel gas flows from right to left in the diagram in the fuel-gas flow passage 11. In this embodiment too, the temperature detector 8, which detects the temperature of the object fluid, is provided on the pipe wall of the outlet pipe 55, which is the outlet of the flow passage of the object fluid. The control unit 6 controls the object fluid feeding unit 7 and the combustion-support-gas feeding unit 4 based on the detection result to adjust the flow rate of the object fluid and the flow rate of the combustion support gas. This embodiment is the same as the first embodiment in that, on the upstream end (the right-hand side in FIG. 5) of the fuel-gas flow passage 11, the number of the tubes 5 is large and the diameter of the fins 51 is small. In the remaining structure, the to embodiments are the same. With the flow direction of the object fluid being the same as that of the fuel gas, the temperatures of the fins 51 and tubes 5 located on the upstream end (right-hand end in FIG. 5), where they are likely to be high as a result of contacting the high-concentration flammable gas, are prevented from becoming abnormally high by the low-temperature object fluid that flows there. When the system is activated, however, catalytic combustion is not carried out sufficiently until the temperature on the downstream side of the flow of the flammable gas (the left-hand end in FIG. 5) reaches the activation temperature of the catalyst. Therefore, unburned gas may be discharged from the exhaust-gas port 13, thus deteriorating the exhaust emissions.

Figure 6:
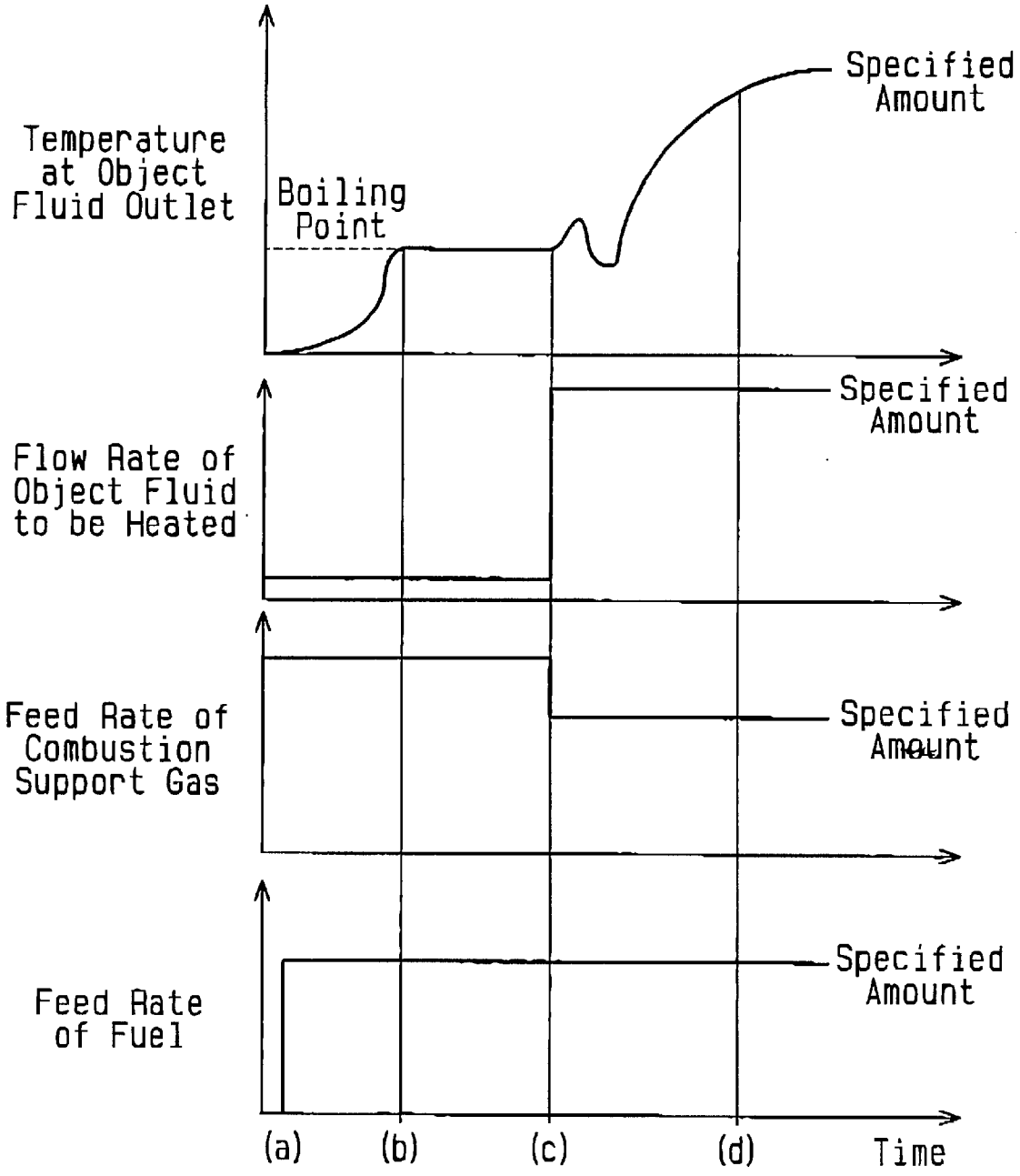
FIG. 6 is a diagram showing the behaviors of individual fluids according to the second embodiment.

In this case, at the activation time of the heater, at time (a) in FIG. 6, the flow rate of the object fluid is small and the flow rate of the combustion support gas is made greater than the specified rate, thus making it easier to transfer the heat generated on the surfaces of the fins 51 to the fuel gas or the combustion exhaust gas. This makes the flow speed of the object fluid sufficiently low that the flow of the object fluid becomes laminar, making it harder to transfer the heat generated on the surfaces of the fins 51 into the tubes 5 and exposing the downstream end of the fuel-gas flow passage 11 to the high-temperature gas, so that the entire heater quickly reaches the activation temperature of the catalyst.

The increase in the flow rate of the combustion support gas is carried out until combustion further progresses after the object fluid has reached the boiling point (time (b) in FIG. 6) and the entire object fluid is vaporized. When the object fluid is vaporized, the heat resistance in the tubes 5 rapidly increases, and when the temperature of the object fluid exceeds the boiling point (time (c) in FIG. 6), the control unit 51 reduces the flow rate of the combustion support gas to the specified rate, thus preventing the heat generated on the surfaces of the fins 51 from being transferred to other than the object fluid in the tubes 5. At the same time, the object fluid feeding unit 7 is controlled to increase the flow rate of the object fluid to the specified rate. This increases the flow speed of the object fluid in the tubes 5 to enhance the heat transfer into the tubes 5, thus making it possible to quickly heat the object fluid to a predetermined temperature.

Figure 7:
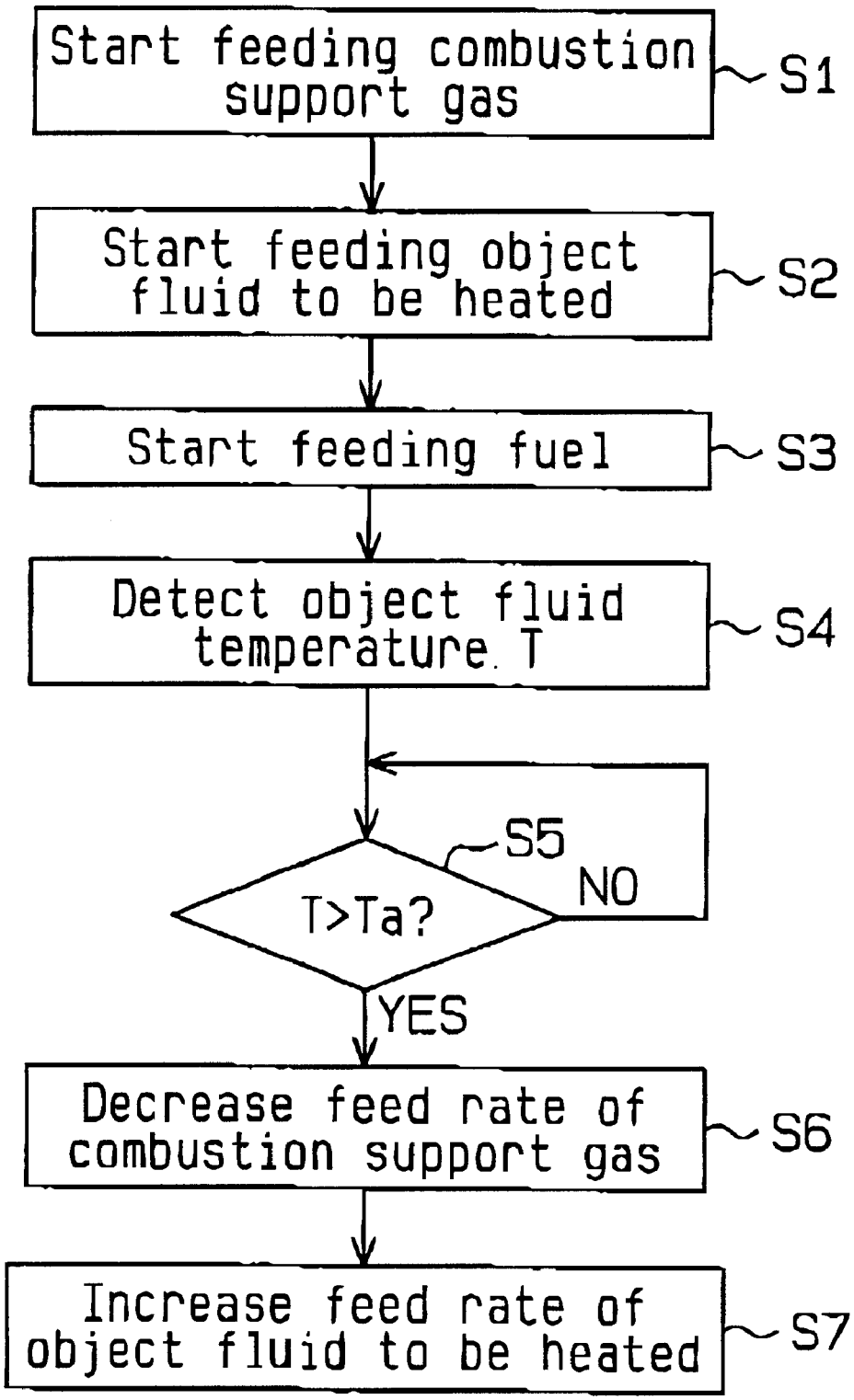
FIG. 7 is a flowchart illustrating a control method according to the second embodiment.

FIG. 7 shows the flowchart of the control by the control means 6 according to this embodiment. According to this flowchart, when the control procedure of this system is initiated, first, the control means 6 causes the combustion-support-gas feeding unit 4 and the object fluid feeding unit 7 to start feeding a greater amount of combustion support gas than the specified amount and a predetermined amount of object fluid (steps 1 and 2), and causes the fuel feeding unit 3 to start feeding a specified amount of fuel (step 3). Next, when the temperature T of the object fluid is detected by the temperature detector 8 (step 4), the control means 6 determines it this temperature T has exceeded the typical boiling point Ta of the object fluid (step 5). This step is repeated and when T>Ta is met, a control signal is sent to the combustion support gas feeding unit 4 to decrease the flow rate of the combustion support gas to the specified rate (step 6) and the object fluid feeding unit 7 is controlled to increase the flow rate of the object fluid to the specified rate (step 7).

What is claimed is:

1. A catalytic combustion heat exchanger comprising:

a fuel-gas flow passage, wherein a fuel gas flows in the fuel-gas flow passage;

a tube, at least a part of which is located in the flow passage, for conducting an object fluid through the heat exchanger, wherein the tube is included in an object fluid flow passage, the object fluid flow passage having an outlet, wherein an oxidation catalyst is located on a surface of the tube within the fuel-gas flow passage for causing an oxidation reaction when the fuel gas contacts the oxidation catalyst, and heat from the reaction heats the object fluid;

a detector for detecting the temperature of the object fluid, in the vicinity of the outlet; and a controller for controlling the flow rate of the object fluid, when the heat exchanger is initially activated, based on the result of the detection, wherein the controller sets the flow rate of the object fluid to a relatively small rate until the temperature of the object fluid exceeds a predetermined temperature, and the controller increases the flow rate of the object fluid when the temperature of the object fluid exceeds the predetermined temperature.

2. The catalytic combustion heat exchanger according to claim 1, wherein the controller sets the flow rate of the object fluid, when the heat exchanger is initially activated, such that the flow of the object fluid is laminar and maintains a laminar flow until the object fluid boils and increases the flow rate of the object fluid to a specified rate when the temperature of the object fluid exceeds its boiling point.

3. The catalytic combustion heat exchanger according to claim 1, wherein the fuel gas is a mixture including a combustion support gas, and the controller also controls the flow rate of the combustion support gas into the fuel-gas flow passage.

4. The catalytic combustion heat exchanger according to claim 3, wherein the direction of flow of the fuel gas is generally opposite to that of the object fluid, and the controller increases the flow rate of the combustion support gas to or above a specified rate when the temperature of the object fluid reaches its boiling point.

5. The catalytic combustion heat exchanger according to claim 4, wherein the controller decreases the flow rate of the combustion support gas when the temperature of the object fluid stabilizes about a target temperature.

6. The catalytic combustion heat exchanger according to claim 3, wherein the direction of flow of the fuel gas is generally the same as that of the object fluid, and the controller sets the flow rate of the combustion support gas to be higher than a specified rate from when the heat exchanger is initially activated until the temperature of the object fluid exceeds its boiling point, and the controller decreases the flow rate of the combustion support gas to the specified rate when the temperature of the object fluid exceeds its boiling point.

7. The catalytic combustion heat exchanger according to claim 1, wherein the tube is one of a plurality of tubes forming the object fluid flow passage, and the tubes are arranged in a plurality of rows, and the number tubes in an most upstream row, with respect to the flow direction of the fuel gas, has more tubes than others of the rows.

8. The catalytic combustion heat exchanger according to claim 1, wherein the tube is one of a plurality of tubes forming the object fluid flow passage, and the tubes are arranged in a plurality of rows, and fins are located on the tubes, and the surface areas of the fins of a most upstream one of the rows, with respect to the flow direction of the fuel gas, are smaller than those of the remaining rows.

9. A method for controlling a catalytic heat exchanger, wherein the heat exchanger heats an object fluid with the heat of an oxidation reaction that occurs with a fuel gas on a catalyst surface, the method comprising:

setting the flow rate of the object fluid through the heat exchanger to a relatively low level, when the heat exchanger is initially activated, until the object fluid exceeds a predetermined temperature, to increase the speed at which the heat exchanger reaches an operating temperature; and increasing the flow rate of the object fluid to a relatively high level when the temperature of the object fluid exceeds the predetermined temperature, to increase the rate of heat transfer to the object fluid.

* * * * *